US011264183B2

(12) United States Patent
Chauhan et al.

(10) Patent No.: US 11,264,183 B2
(45) Date of Patent: Mar. 1, 2022

(54) SPRING LOADED AUXILIARY CONTACT SYSTEM FOR BUS TRANSFER SWITCHING IN A CENTER BREAK SWITCH

(71) Applicant: Hitachi Energy Switzerland AG, Baden (CH)

(72) Inventors: Kalpesh Ishwarbhai Chauhan, Vadodara (IN); Krunal Kansara, Vadodara (IN); Manish Sinjonia, Vadodara (IN); Shashwat Chauhan, Ahmedabad (IN)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/042,131

(22) PCT Filed: Mar. 11, 2019

(86) PCT No.: PCT/IB2019/051949
§ 371 (c)(1),
(2) Date: Sep. 27, 2020

(87) PCT Pub. No.: WO2019/186308
PCT Pub. Date: Oct. 3, 2019

(65) Prior Publication Data

US 2021/0012978 A1 Jan. 14, 2021

(30) Foreign Application Priority Data

Mar. 28, 2018 (IN) ..... 201841011684

(51) Int. Cl.
*H01H 1/38* (2006.01)
*H01H 31/00* (2006.01)
(Continued)

(52) U.S. Cl.
CPC ..... *H01H 1/385* (2013.01); *H01H 31/003* (2013.01); *H01H 31/28* (2013.01); *H01H 33/12* (2013.01)

(58) Field of Classification Search
CPC ..... H01H 1/385; H01H 1/44; H01H 31/003; H01H 31/28; H01H 31/20; H01H 31/006;
(Continued)

(56) References Cited

U.S. PATENT DOCUMENTS 2,709,739 A * 5/1955 Gilliland ..... H01H 31/28 200/256
2,835,756 A * 5/1958 Bagnagatti ..... H01H 31/28 200/48 CB (Continued)

FOREIGN PATENT DOCUMENTS

FR 3016470 A 7/2015
WO 2015197785 A1 12/2015

OTHER PUBLICATIONS

International Search Report and Written Opinion of the International Searching Authority, PCT/IB2019/051949, dated May 28, 2019, 9 pages.

(Continued)

*Primary Examiner* — William A Bolton
(74) *Attorney, Agent, or Firm* — Sage Patent Group

(57) ABSTRACT

The invention relates to a center break switch having a contact system for electrical current conduction and bus transfer switching. The contact system includes two moving contacts. One of the two moving contacts includes a finger contact and the other moving contact includes a first contact. Each moving contact includes a contact for bus transfer switching, wherein one of the two contacts includes a spherical contacting element, and the other contact includes a rectangular contacting element. The spherical contacting element and the rectangular contacting element engage
(Continued)

during switching for the bus transfer, and stay in contact when the finger contact is engaged with the first contact for electrical current conduction.

12 Claims, 3 Drawing Sheets

(51) Int. Cl.
*H01H 31/28* (2006.01)
*H01H 33/12* (2006.01)

(58) Field of Classification Search
CPC ..... H01H 31/283; H01H 31/32; H01H 2031/286; H01H 33/12
USPC ..... 200/48 CB, 48 P, 48 A, 48 KB, 48 V, 200/48 SB; 218/146
See application file for complete search history.

(56) References Cited

U.S. PATENT DOCUMENTS

| | | | | |
|---|---|---|---|---|
| 3,148,260 | A | 9/1964 | Upton | |
| 3,201,535 | A * | 8/1965 | Sabol | H01H 1/5833 200/48 CB |
| 3,339,037 | A * | 8/1967 | Bernatt | H01H 33/128 200/48 CB |
| 3,634,634 | A * | 1/1972 | Cole | H01H 31/30 200/48 SB |
| 4,103,120 | A * | 7/1978 | Jarosz | H01H 31/00 200/48 A |
| 4,564,731 | A | 1/1986 | Hartig | |
| 5,293,012 | A * | 3/1994 | Levi | H01H 31/28 200/275 |
| 6,984,795 | B1 * | 1/2006 | Kowalik | H01H 31/28 200/48 CB |
| 7,804,033 | B2 * | 9/2010 | Dianin | H01H 31/28 200/48 CB |

OTHER PUBLICATIONS

Ruhrtah GmbH & Co. OHG, Product Literature, "Power Transmission and Distribution—Disconnectors and Earthing Switches, 36kV up to 800kV," www.ruhrtal-high-voltage.de.

* cited by examiner

SPRING LOADED AUXILIARY CONTACT SYSTEM FOR BUS TRANSFER SWITCHING IN A CENTER BREAK SWITCH

CROSS REFERENCE TO RELATED APPLICATIONS

This application is a 35 U.S.C. § 371 national stage application of PCT International Application No. PCT/IB2019/051949 filed on Mar. 11, 2019, which in turns claims foreign priority to Indian Patent Application No. 201841011684 filed on Mar. 28, 2018, the disclosures and content of which are incorporated by reference herein in their entirety.

FIELD OF THE INVENTION

The present invention generally relates to center break switches. More specifically, the present invention relates to contact systems for electrical current conduction and bus transfer switching in such switches.

BACKGROUND OF THE INVENTION

Switchgear (e.g. disconnector) may be used for load transfer between buses (bus transfer). In such applications, the switchgear has the making/breaking capability, to handle the electrical/mechanical stresses involved in the bus transfer. Usually the switchgear contacts (fixed/moving) are designed to handle the electrical/mechanical stresses in the bus transfer. These contacts are typically the contact pins and/or the contact plate/fingers, either of which may be provided as a fixed or movable contact.

With increase in demand, high voltage switchgear (e.g. around 100 kV or above) for higher current ratings (e.g. around 2000 A, or more) are desired. It is required to support bus transfer switching at such ratings. Also, depending on the type, different making/breaking capabilities are required. As the rating increases, the switchgear contacts are exposed to higher wear and tear as a result of increase in the electrical/mechanical stresses.

Consider a center break switch with two moving contacts. One moving contact may have contact fingers, and the other contact may have complimentary first contact. The contact fingers and first contact are not suitable to handle the electrical/mechanical stresses for such high ratings.

In view of the above, there is a need for switchgear with improved contact systems for such higher ratings.

SUMMARY OF THE INVENTION

The present invention provides a switchgear having contact system for electrical current conduction and bus transfer switching. In accordance with various embodiments, the switchgear is a center break switch. The center break switch can be a disconnector.

The contact system of the center break switch comprises two moving contacts. Here, a first moving contact of the two moving contacts comprises a finger contact, and a second moving contact of the two moving contacts comprises a first contact. Each moving contact comprises a contact for bus transfer switching. During engagement, the two contacts for bus transfer switching engage prior to the engagement of the finger contact with the first contact. During disengagement, the two contacts for bus transfer switching are the last to disengage. Thus, the two contacts for bus transfer switching are first in contact during closing, and last out contact during opening operation.

A first contact of the two contacts for bus transfer switching, is a contact finger. The contact finger comprises a spherical contacting element provided at an end of an auxiliary finger formed with a cylindrical rod. The auxiliary finger is attached with a first supporting base with a spring. For example, the supporting base has a slot (or hole), and the auxiliary finger is attached at the slot using connections such as guide rings, lock washers etc. The first supporting base is mounted on the corresponding moving contact. In one embodiment, the first supporting base is mounted on the moving contact comprising the finger contact. Here, the mounting is such that the auxiliary finger is arranged in parallel to contact fingers of the finger contact.

In accordance with an embodiment, the spring is provided between a pin-washer arrangement (protrusion) on the auxiliary finger and the first support base. For example, there could be a circular protrusion on the auxiliary finger to allow for attachment of the spring. The spring can be a compression spring. Thus, the spring can provides initial compression during switching and maintain contact pressure during engagement between the finger contact and the first contact.

The attachment of the auxiliary finger is such that the auxiliary finger turns according to a turning movement of the corresponding moving contact. In addition, the auxiliary finger moves relative to the first supporting base along a first axis on being pushed by a second contact of the two contacts during switching. Thus, the auxiliary finger turns with the corresponding moving contact till the two contacts for bus transfer switching come into contact with each other. Once the two contacts for bus transfer switching come into contact, as the two moving contacts further rotate, the second contact pushes the first contact, causing the movement of the auxiliary finger relative to the first supporting base.

The second contact of the two contacts for bus transfer switching, comprises a rectangular contacting element. The second contact is attached with a second supporting base. The second supporting base is mounted on the corresponding moving contact. In one embodiment, the second supporting base comprises an insulating guide, wherein the rectangular contacting element is provided between planar guiding elements of the insulating guide. In one embodiment, the second supporting base is mounted on the moving contact comprising the first contact. The attachment is such that the second contact turns according to the movement of the corresponding moving contact. Here, the rectangular contacting element may be provided in parallel to a surface of the first contact.

The rectangular contacting element is positioned to engage with the spherical contacting element during switching for the bus transfer. Thus, when the two moving contacts turn, the rectangular contacting element comes in contact with the spherical contacting element. Thereafter, as the two moving contacts further rotate, motion is transmitted to the first contact from the second contact (i.e. the auxiliary finger is pushed with the rectangular contacting element). The auxiliary finger is pushed till the finger contact is fully engaged with the first contact. Here, the spring assists in maintaining contact pressure during engagement between the finger contact and the first contact.

BRIEF DESCRIPTION OF DRAWINGS

The subject matter of the invention will be explained in more detail in the following text with reference to exemplary embodiments which are illustrated in attached drawings in which.

DETAILED DESCRIPTION

Figure 1:
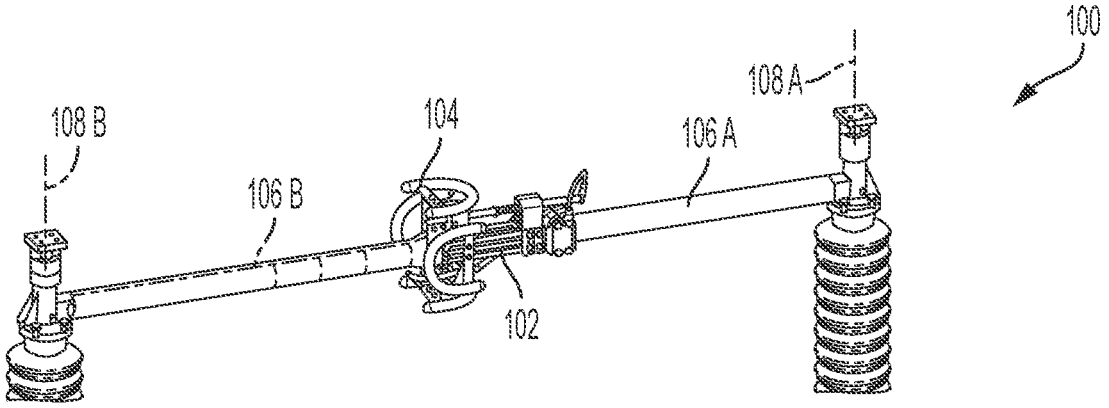
FIG. 1 shows a center break switch, in accordance with an embodiment of the invention.

Various embodiments of the present invention relate to electrical switchgear such as, but not limited to, center break switches, vertical break switches, knee type switches etc. FIG. 1 shows a center break switch (100), in accordance with an embodiment of the invention. In the embodiment shown in FIG. 1, the switch is a disconnector. As shown, the disconnector has two moving contacts (102, 104). In FIG. 1, the two contacts are in an engaged position (for electrical current conduction). Each moving contact is provided at the end of a corresponding current pipe (106A, 106B). The pipes can turn (or rotate) about an axis (108A, 108B), for moving the corresponding moving contacts for opening or closing the switch. The axis may be the axis of the driving component (e.g. driving insulator) to which the pipes are connected.

Figure 2:
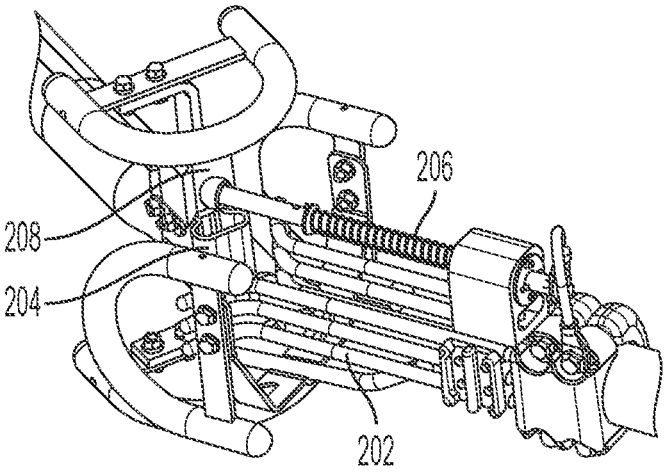
FIGS. 2 and 3 show different positions of contacts of the center break switch during switching, in accordance with an embodiment of the invention.

As shown in FIG. 2, each moving contact comprises a main contact (202, 204) and an auxiliary contact (206, 208) for bus transfer switching. The main contacts engage for electrical current conduction when the switch is in the closed position. In the embodiment of FIG. 2, a first moving contact comprises a finger contact (202), and a second moving contact comprises a first contact (204). The finger contact, as shown in FIG. 2, can have a plurality of contact fingers. The number of contact fingers can vary depending on the rating of the switchgear. The contact fingers in this embodiment are arranged in two sets, to engage with corresponding surfaces of the first contact (204) for electrical current conduction.

Figure 3:
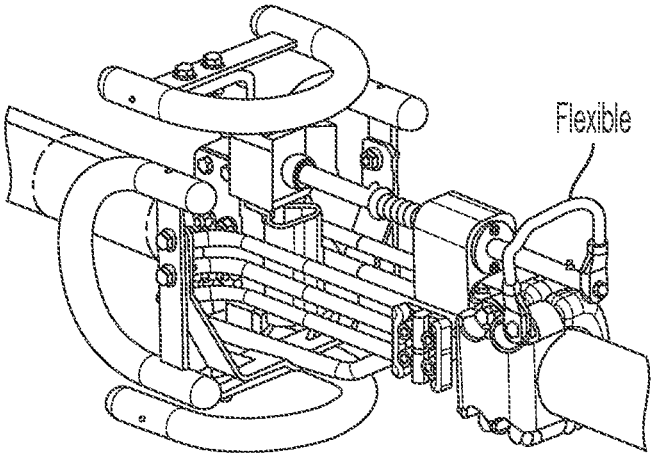

The two contacts (auxiliary contacts 206, 208) for bus transfer switching are the first one to engage and last one to disengage. As can be seen in FIG. 2, the two contacts for bus transfer switching are beginning to engage while the main contacts are yet to engage. In FIG. 3 the main contacts are fully engaged, and in this position, the two contacts for bus transfer switching are also engaged. As will be apparent, during opening, the main contacts will disengage first, after which the auxiliary contacts disengage. Thus, the two contacts for bus transfer switching are first in contact during closing, and last out contact during opening operation.

Figure 4:
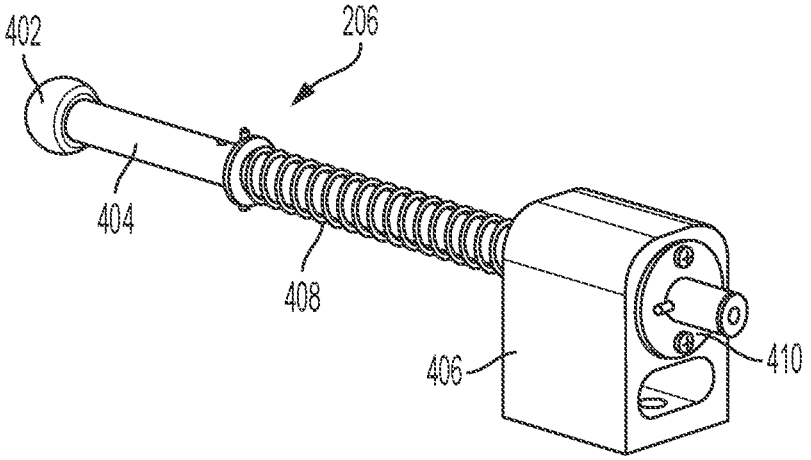
FIG. 4 shows a contact assembly of a contact for bus transfer switching, in accordance with an embodiment of the invention.

A first contact (206) of the two contacts for bus transfer switching, is an auxiliary contact finger as can be seen in FIG. 4. The contact finger comprises a spherical contacting element (402) provided at an end of an auxiliary finger formed with a cylindrical rod (404). The contact finger may be a single piece, wherein the spherical contacting element and the auxiliary finger are both made from a conductive material (e.g. copper alloy or aluminum alloy). Alternately, the spherical contacting element may be made from Tungsten while the rod is made from an alloy of copper or alloy of aluminum.

Figure 5:
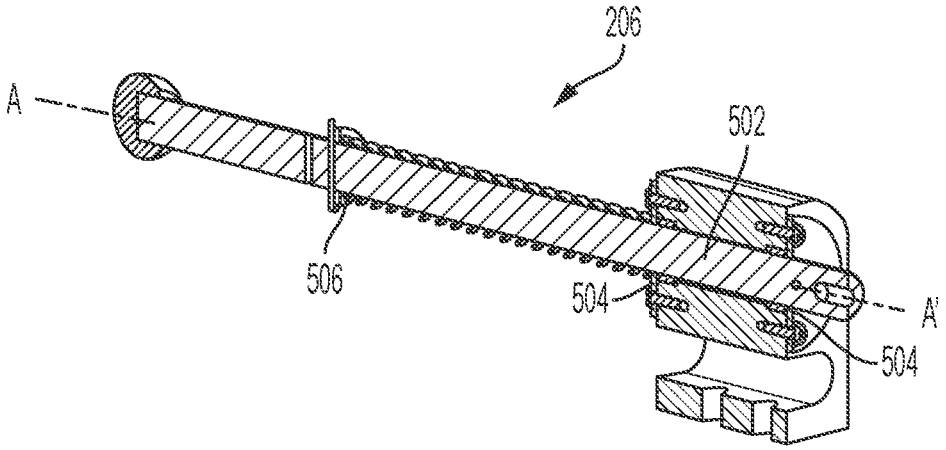
FIG. 5 shows a sectional view of the contact assembly, in accordance with the embodiment of the invention.

As shown, the auxiliary finger is attached with a first supporting base (406) with a spring (408). In the embodiment of FIG. 4, the supporting base has a slot (or hole) such as 502 shown in FIG. 5, and the cylindrical rod is attached at the slot using connections such as guide rings (504), lock washers (410) etc. The spring is provided between a protrusion from the pin-washer arrangement on the cylindrical rod and the first support base. In the embodiment of FIG. 4, the protrusion is circular (506). The spring can be a compression spring. Thus, the spring can provides initial compression during switching and maintain contact pressure during engagement between the finger contact and the first contact.

The first supporting base is mounted on the corresponding moving contact. In the embodiment shown in FIGS. 1-3, the first supporting base is mounted on the moving contact comprising the finger contact (i.e. 102). Here, the mounting is such that the auxiliary finger is arranged in parallel to contact fingers of the finger contact. The attachment of the auxiliary finger is such that the auxiliary finger turns according to a turning movement of the corresponding moving contact. In addition, the auxiliary finger moves relative to the first supporting base along a first axis (i.e. AA') on being pushed by a second contact of the two contacts during switching.

Thus, the auxiliary finger turns with the finger contact till the spherical contacting element comes into contact with a rectangular contacting element of the other contact for bus transfer switching (i.e. position shown in FIG. 2). Once the two contacts for bus transfer switching come into contact, as the two moving contacts further rotate, the second contact pushes the first contact, causing the movement of the auxiliary finger (cylindrical rod) relative to the first supporting base along the first axis.

Figure 6:
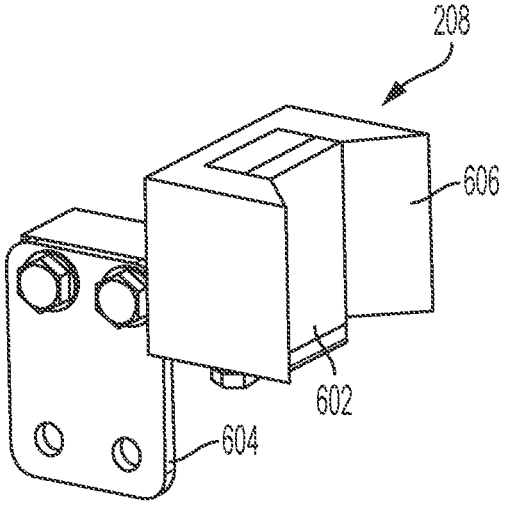
FIG. 6 shows a perspective view of a contact assembly of another contact for bus transfer switching, in accordance with an embodiment of the invention.

The second contact (208) of the two contacts for bus transfer switching, comprises the rectangular contacting element (602) as shown in FIG. 6. The second contact is attached with a second supporting base (604). The supporting base can have an insulating guide. The guide can have planar guiding elements (606) as shown in FIG. 6. Thus, the first contact (i.e. with the spherical contacting element) can be guided to engage with the rectangular contacting element for bus transfer.

Figure 7:
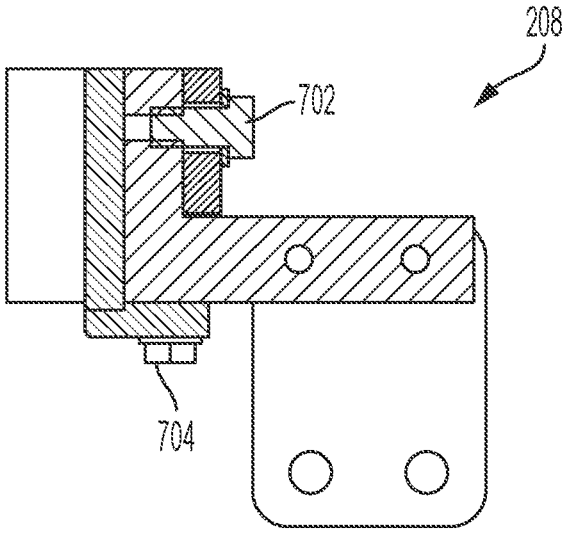
FIG. 7 shows a sectional view of the contact assembly of the other contact for bus transfer switching, in accordance with the embodiment of the invention.

The contact can be attached with the supporting base using connections such as bolts (702, 704) as shown in FIG. 7. In the embodiment shown in FIG. 6, the supporting base comprises plates. The plates enable mounting of the rectangular contacting element in parallel to the planar surface of the first contact (refer FIGS. 2 & 3, which show the mounting of the rectangular contacting element relative to the first contact planar surface). In the embodiment shown in FIGS. 2 and 3, the second supporting base is mounted on the moving contact having the first contact. The attachment is such that the second contact turns according to the movement of the corresponding moving contact.

The rectangular contacting element is positioned to engage with the spherical contacting element during switching for the bus transfer. Thus, when the two moving contacts turn, the rectangular contacting element comes in contact with the spherical contacting element. Thereafter, as the two moving contacts further rotate, the rectangular contacting element pushes the spherical contacting element and the auxiliary finger. The auxiliary finger is pushed till the finger contact is fully engaged with the first contact (as shown in FIG. 3). Here, the spring assists in maintaining contact pressure during engagement between the finger contact and the first contact.

Due to the spherical shape of the contacting element, the contact point position changes during closing/opening operation. This helps in bus transfer switching. For example, due to arcing, some material can erode and because of different contact position, some material will always be there to sustain arcing. Further, the spring provides pre-tension and necessary contact pressure. As some material may be eroded during arcing, the contact pressure can vary. Here, to keep contact pressure, some force will be required, which can be provided through the spring. The spring can also ensure sufficient contact pressure even when some material is lost during contact (e.g. due to erosion).

We claim:

1. A center break switch having a contact system for electrical current conduction and bus transfer switching, the contact system comprising:

two moving contacts comprising a first moving contact and a second moving contact, the first moving contact comprising a finger contact, the second moving contact comprising a first contact, the two moving contacts further comprising respective contacts for bus transfer switching, the respective contacts for bus transfer switching configured to engage prior to an engagement of the finger contact with the first contact, the respective contacts for bus transfer switching comprising a first contact for bus transfer switching comprising a contact finger comprising a spherical contacting element provided at an end of an auxiliary finger formed with a cylindrical rod, the auxiliary finger attached to a first supporting base with a spring, the first supporting base mounted on the moving contact of the two moving contacts corresponding to the first contact for bus transfer switching, the cylindrical rod configured to turn according to a turning movement of the moving contact of the two moving contacts corresponding to the first contact for bus transfer switching, and the cylindrical rod configured to move relative to the first supporting base along a first axis on being pushed by the second moving contact during switching, and the respective contacts for bus transfer switching comprising a second contact for bus transfer switching comprising a rectangular contacting element, the second contact attached with a second supporting base mounted on the moving contact of the two moving contacts corresponding to the second contact for bus transfer switching, the second contact for bus transfer switching configured to turn according to the movement of the moving contact of the two moving contacts corresponding to the second contact for bus transfer switching, and the rectangular contacting element positioned to engage with the spherical contacting element during switching for the bus transfer, and stay in contact with the spherical contacting element when the finger contact is engaged with the first contact for electrical current conduction.

2. The center break switch of claim 1, wherein the second supporting base comprises an insulating guide, wherein the rectangular contacting element is provided between planar guiding elements of the insulating guide.

3. The center break switch of claim 1, wherein the first supporting base is mounted on the first moving contact comprising the finger contact such that the cylindrical rod of the auxiliary finger is arranged in parallel to contact fingers of the finger contact, and the second supporting base is mounted on the second moving contact comprising the first contact.

4. The center break switch of claim 1, wherein the first contact for bus transfer switching is attached with the first supporting base such that the spring provides initial compression during switching and maintains contact pressure during engagement between the finger contact and the first contact.

5. The center break switch of claim 1, wherein the auxiliary finger comprises a pin-washer arrangement and the spring is attached between the first supporting base and the pin-washer arrangement.

6. The center break switch of claim 1, wherein the center break switch is a disconnector.

7. A moving contact system for a center break switch, the moving contact system comprising:

a first moving contact comprising:

a finger contact; and a first bus transfer switching contact comprising a contact finger movably coupled to a first base, the contact finger comprising a rounded contacting element; and a second moving contact comprising:

a first contact, wherein the finger contact is configured to engage the first contact to conduct electrical current; and a second bus transfer switching contact comprising a flat contacting element coupled to a second base, wherein the flat contacting element is configured to engage the rounded contacting element during switching for bus transfer between the first moving contact and the second moving contact prior to an engagement of the contact finger with the first contact, wherein the contact finger of the first bus transfer switching contact is biased toward the flat contacting element to maintain engagement between the rounded contacting element and the flat contacting element during movement of the first moving contact and the second moving contact with respect to each other.

8. The moving contact system of claim 7, wherein the second moving contact further comprises a plurality of guiding elements configured to guide the rounded contacting element toward the flat contacting element.

9. The moving contact system of claim 8, wherein the plurality of guiding elements are non-conductive.

10. The moving contact system of claim 7, wherein the finger contact comprises a plurality of contact fingers arranged parallel to the contact finger of the first bus transfer switching contact.

11. The moving contact system of claim 7, wherein the first bus transfer switching contact comprises a spring that biases the contact finger of the first bus transfer switching contact toward the flat contacting element of the second bus transfer switching contact.

12. The moving contact system of claim 11, further comprising a pin-washer arrangement, wherein the spring is attached between the first base and the pin-washer arrangement.

* * * * *